US005778570A

United States Patent [19]

Eichelberger

[11] Patent Number: 5,778,570

[45] Date of Patent: Jul. 14, 1998

[54] EXCAVATOR TOOTH

[75] Inventor: Peter Eichelberger, Unterägeri, Switzerland

[73] Assignee: Baz Service AG, Switzerland

[21] Appl. No.: 558,276

[22] Filed: Nov. 13, 1995

[51] Int. Cl.[6] ..... E02F 9/28

[52] U.S. Cl. ..... 37/450; 37/456; 37/454

[58] Field of Search ..... 37/450, 451, 452, 37/453, 454, 455, 456; 172/701.3, 772, 753

[56] References Cited

U.S. PATENT DOCUMENTS

| | | | |
|---|---|---|---|
| 2,762,139 | 9/1956 | Launder | 37/456 X |
| 3,326,302 | 6/1967 | Washbond et al. | 37/452 X |
| 3,536,147 | 10/1970 | Norton et al. | 37/453 X |
| 3,624,827 | 11/1971 | Liess et al. | 37/456 X |
| 3,748,763 | 7/1973 | Zepf | 37/452 |
| 3,959,901 | 6/1976 | Klett | 37/452 |
| 4,227,744 | 10/1980 | Livesay | 37/452 X |
| 4,360,981 | 11/1982 | Bierwith et al. | 37/450 |
| 4,481,728 | 11/1984 | Mulder et al. | 37/456 X |
| 4,980,980 | 1/1991 | Schadov et al. | 37/452 |
| 5,018,283 | 5/1991 | Fellner | 37/452 |
| 5,177,886 | 1/1993 | Klett | 37/456 X |
| 5,325,615 | 7/1994 | Hutchins et al. | 37/454 X |
| 5,379,535 | 1/1995 | Bowes, Jr. | 37/452 |

OTHER PUBLICATIONS

Caterpillar Ground Engaging Tools Brochure, Sixth Edition, p. 8, Jun. 1995.

*Primary Examiner*—Terry Lee Melius
*Assistant Examiner*—Victor Batson
*Attorney, Agent, or Firm*—Bachman & LaPointe, P.C.

[57] ABSTRACT

The excavator tooth has a tooth holder (1) on one end of which a wedge-shaped tooth nose (3) is developed. The tooth nose (3) bears a wedge-shaped tooth cap (5) in which a wedge-shaped hollow space (24) is recessed. With the tooth cap (5) mounted, the hollow space (24) is pushed over the tooth nose (3), which thus supports the tooth cap (5). For a good support, the wedge surfaces (8, 9) of the tooth nose (3) have radii of curvature curved convexly perpendicular to the longitudinal axis (16) and continuously decreasing from the tooth edge (7) to the nose root (17). In corresponding manner, the wedge surfaces (25, 26) of the hollow space (24) have concavely curved radii of curvature which continuously decrease from the base (28) to the mouth (29) of the hollow space (24). In this way a large application surface of the tooth cap (5) on the tooth nose (3) is obtained. In order to secure the tooth flap (sic) (5), a locking pin is provided which passes through the holes (20, 34) in the tooth nose (3) and the side surfaces of the tooth cap (5) and holds the latter fast.

10 Claims, 3 Drawing Sheets

EXCAVATOR TOOTH

BACKGROUND OF THE INVENTION

The present invention relates to an excavator tooth.

Practically all excavator buckets are provided with a number of excavator teeth. However, other construction machines, for instance loaders, graders and augers, are equipped on their working tools with cutting teeth of the same type as those used on excavator shovels. The excavator tooth consists essentially of two parts, a tooth holder and a tooth cap. The tooth holder serves for the attachment of the tooth to the operating tool and is provided on one end with a tooth nose which is of approximately wedge shape and bears the tooth cap. The tooth cap is a wedge-shaped body provided with a hollow space which is open on one side, it being pushed over the tooth nose and fastened. By the two-piece development of the excavator tooth, the fact is taken into account that, in particular, the tooth cap is subjected to considerable wear in operation. It must therefore be replaced when necessary, while the tooth holder remains intact.

In view of the large forces which act, in operation, on the tooth cap, a good attachment between the tooth nose and the tooth cap is necessary. Experience has shown that a good attachment between tooth nose and tooth cap is difficult to obtain. Most of such attachments which have been proposed up to now are proof of this. To be sure, there are suitable methods of manufacture for manufacturing excavator teeth with customary tolerances, either by casting or by drop-forging. Nevertheless, additional holding means are provided which are intended to assure a better holding of the tooth cap.

Federal Republic of Germany Patent 605 211 describes a two-piece shovel tooth in which the tooth nose has, at the root of the nose, on both sides, support surfaces on which projections on the mouth of the hollow space of the tooth cap rest. Further support of the tooth cap is present at the base of the hollow space of the tooth cap. In this way, the tooth cap is supported in punctiform or linear manner and the supporting places are placed under high load in operation and therefore wear rapidly. This has the result that the locking bolt which locks the tooth cap on the tooth nose is developed as a solid play-free fastening bolt which cooperates in the transmitting of the forces which act on the tooth cap. However, in this case also, large local stresses occur which lead to a correspondingly large amount of wear.

Federal Republic of Germany Patent 255 595 also shows such a development of an excavator tooth. The wedge-shaped tooth nose has a curved wedge surface which is developed as a body of revolution, the longitudinal axis of the fastening bolt coinciding approximately with the axis of the body of revolution. The tooth cap is to have a recess which is adapted to the wedge shape of the tooth nose. In order, however, for the forces to be reliably transmitted by the tooth cap, tongues are arranged at the mouth of the recess in the tooth cap, these tongues being received by recesses at the root of the nose. Together with arcuate recesses which are arranged on the side walls of the tooth nose and cooperate with surfaces of the tooth cap the tooth is supported locally and it thus has places of increased stress with a correspondingly large amount of wear. Furthermore, it is necessary for these places which engage one within the other to be held together, for which a fastening bolt with the use of an elastic lock is used.

From U.S. Pat. No. 2,050,014 there is also known an excavator tooth the tooth nose of which is shaped with curved wedge surfaces, which surfaces, however, are curved inward so that the corners of the recesses of the tooth cap have an acute angle of less than 90°. The tooth cap furthermore has a relatively thin wall and is intended to deform upon the mounting. The use of such excavator teeth is thus possible only in the case of light earth, for instance, sandy earth.

SUMMARY OF THE INVENTION

The invention also relates to a two-piece excavator tooth, but one which, however, does not have the limitations of the known excavator teeth. Rather, in it, the wedge surfaces of the tooth nose and of the recess in the tooth cap are so developed that surface application of the wedge surfaces takes place over which the forces acting on the tooth nose are conducted further, regardless of the direction from which they act on the tooth nose.

This solution is provided by an excavator tooth which has the features set forth.

BRIEF DESCRIPTION OF THE DRAWINGS

The invention will now be described with reference to an embodiment which is shown in the figures of the accompanying drawing, in which.

DETAILED DESCRIPTION OF PREFERRED EMBODIMENTS

Figure 1:
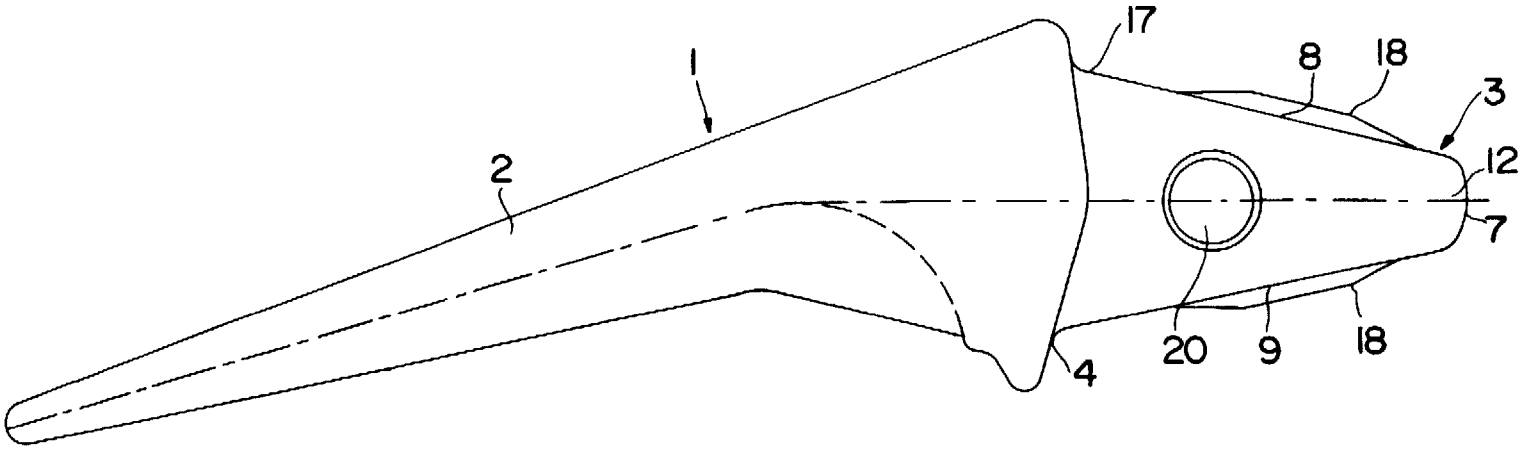
FIG. 1 is a side elevation of the tooth holder of an excavator tooth having a wedge-shaped tooth nose.
Figure 2:
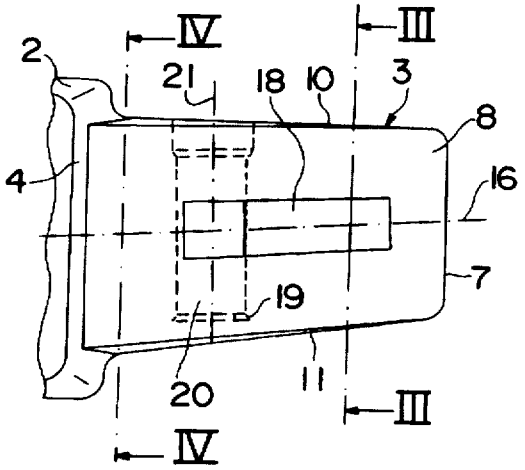
FIG. 2 is a plan view of the tooth nose of the excavator tooth of FIG. 1.
Figure 5:
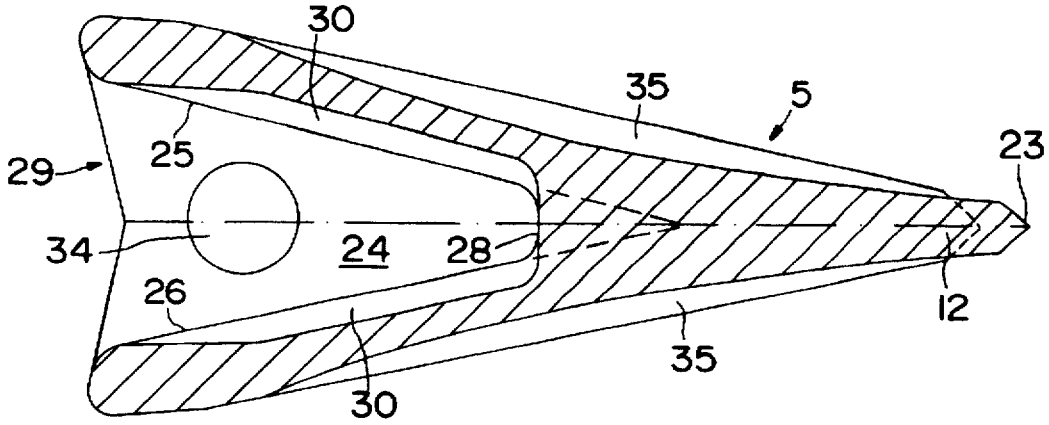
FIG. 5 is a longitudinal section through the tooth cap of an excavator tooth having a wedge-shaped recess which fits the tooth nose of FIGS. 2 to 4.

The tooth holder 1 shown in FIG. 1 is formed of a fastening part 2 and a tooth nose 3. By the fastening part 2, the tooth holder 1 is fastened to a work tool of a construction machine, for instance to the edge of an excavator bucket, being preferably welded thereto. The fastening part 2 can be of any shape, its end surface 4, as the part which is directly connected with the tooth nose 3 remaining unchanged or being changed only to such an extent that the tooth nose is not affected. Whether the fastening part 2 is developed with one arm or two arms is unimportant. The invention concerns solely the tooth nose 3 and the tooth cap 5 which can be placed thereon; see FIGS. 2 and 5.

The tooth nose 3 is a wedge-shaped body having a rounded nose edge 7. Its two wedge surfaces 8, 9 are limited by side surfaces 10, 11, which are developed slightly gable shaped with respect to the central plane 12 of the wedge surfaces 8, 9. The wedge surfaces 8, 9 of the tooth nose 3 are convexly curved and have a arcuate profile 15. The radius of curvature R of the profile 15 perpendicular to the longitudinal axis 16 varies continuously from the nose root 17 to the nose edge 7, doing so with increasing radius of curvature R. The ratio of the radii R at these places is about 1:1.38 to 1:1.64, and preferably 1:1.5.

On the wedge surfaces 8, 9 of the tooth nose 3, there is developed a guide web 18 which extends over the central region of the longitudinal axis of the tooth nose 3 and passes, spaced from the nose edge 7, into the wedge surface 8,9. The width of the guide web 18 is less than about one-third of the width of the wedge surfaces 8, 9 and its height is only a few millimeters, for instance 3 to 5 mm.

A hole 20 passes through the tooth nose 3. Its axis 21 extends in or parallel to the central plane 12 of the tooth nose 3. Furthermore, at the ends of the hole its diameter is 3 to 4 mm greater than the diameter in the central part of the hole 20 and passes with a bevel 19 into the central part of the hole. By this arrangement, the wedge surfaces 8, 9 are completely available for supporting the tooth cap 5.

The side surfaces 10, 11 extend somewhat conically to the longitudinal axis. They are not required for the taking up of lateral forces; this is done by the curvature of the wedge surfaces and, to a lesser extent, by the guide web 18.

Figure 4:
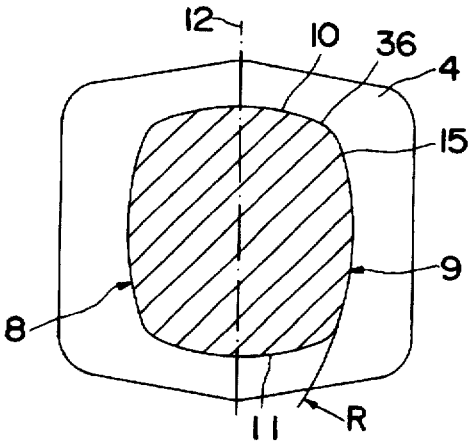
FIG. 4 is a cross section along the line IV—IV of FIG. 2.

On the nose root 17, the tooth nose 3 is limited by the end surface 4 of the fastening part 2 which has the shape of an obtuse wedge the edge of which lies in the central plane 12 of the tooth nose 3. The end surface 4 extends over the edges of the nose root 17 (see FIG. 4) and has approximately the length of the edge of the tooth cap 5.

Figure 6:
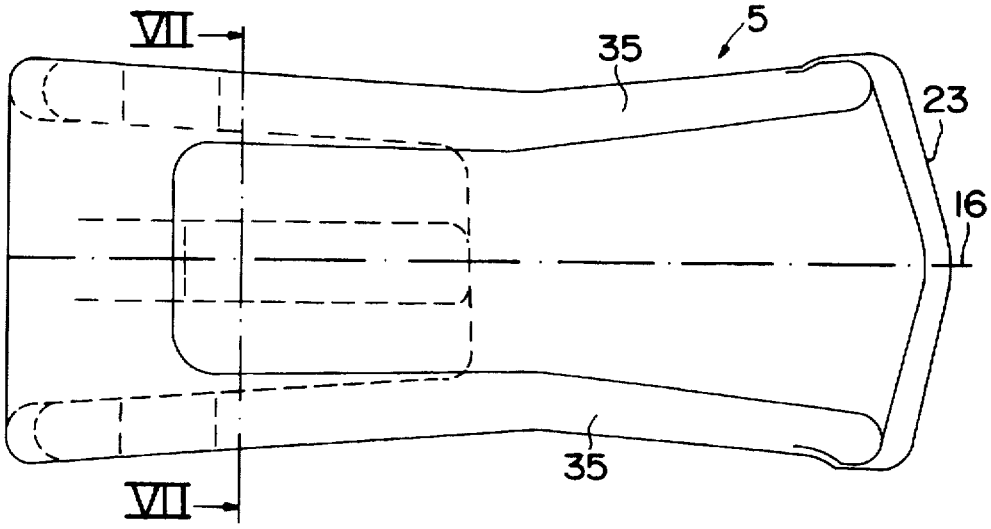
FIG. 6 is a plan view of the tooth cap of FIG. 5.
Figure 7:
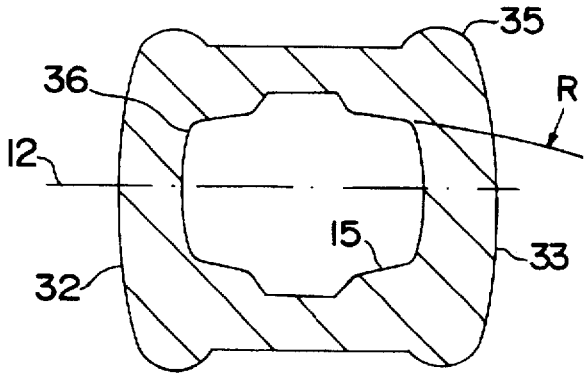
FIG. 7 is a cross section along the line VII—VII of FIG. 6.

The tooth cap 5 (see FIGS. 5 and 6) is a wedge-shaped body the edge 23 of which extends in gable shape with respect to the longitudinal axis 16. The tooth cap 5 has a wedge-shaped hollow space 24 the dimensions of which agree identically with those of the tooth nose 3 and the wedge surfaces 25, 26 of which are curved concavely by exactly the same amount that the wedge surfaces 8, 9 of the tooth nose 3 are curved convexly. Accordingly, the radii of curvature R of the circular profiles lying perpendicular to the longitudinal axis 16 also extend in the same manner as in the case of the tooth cap 3, i.e. continuously from the bottom 28 of the hollow space 24 up to the mouth 29 with decreasing radius of curvature. Corresponding to the guide webs 18 of the tooth nose 3, a groove 30 is recessed in the wedge surfaces 25, 26 of the hollow space 24, this groove serving to receive the guide web 18 of the tooth nose 3; see FIG. 7. The latter does not extend (see FIG. 5) to the edge of the mouth 29, but terminates previously and passes into the wedge surfaces 25, 26. In this way, the result is obtained that, in the region of the mouth 29, an uninterrupted wall portion of the hollow space 24 is present which rests on an also uninterrupted wall portion of the nose root 17. There are no holding means for the local holding of the tooth cap such as are used in excavator teeth and the hole for a fastening bolt also passes through the tooth nose 3 and the tooth cap 5 outside of the wedge surfaces 8, 9, 25, 26.

The outer shape of the tooth cap 5 (see FIGS. 6 and 7) has a greater width at the wedge edge 23 than in the region of the mouth. Ribs 35 extend along the longitudinal edges, while a hole 34 to receive the locking pin, preferably a heavy-type dowel pin, is provided on the side surfaces 32, 33, said hole having a diameter which is somewhat greater than the hole in the tooth nose 3.

The locking pin does not have the object here of conducting large forces from the tooth cap 5 to the tooth nose 3, this is done by the surface application of the wedge surfaces 8, 9, 25, 26 but, it serves to secure the holding together of tooth cap 5 and tooth nose 3.

Figure 3:
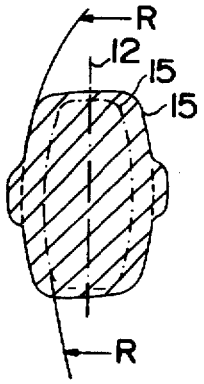
FIG. 3 is a cross section along the line III—III of FIG. 2.

The tooth holder 1 and the tooth cap 5 are preferably produced as drop-forged parts. The casting of these parts is also possible, but with drop-forging higher strength is obtained due to the possibility of using high-alloy steels. The profiles 15 of the wedge surfaces 8, 9 of the tooth nose 5 are imparted a rounding 36 at the edges (see FIG. 3), as are also the wedge surfaces 25, 26 of the tooth cap 5 (see FIG. 7).

By the development of the tooth nose 3 and the tooth cap 5 in the manner described, a large application surface on the wedge surfaces 8, 9, 25, 26 is surprisingly obtained despite the customary tolerances. Local, highly loaded places are thereby avoided. The locking bolt does not pass, as in the known embodiments, through the bearing wedge surfaces but through places subject to little load in the side surfaces 10, 11, 32, 33. Therefore, the hole 20 can also be somewhat larger at the ends than in the central part. This facilitates the mounting of the locking bolt if, in the case of a working tool, the distance between the excavator teeth is relatively small. In such case, the locking bolt can be introduced obliquely into the hole 20 and be hammered in place, it sliding over the bevel 19 into the central part of the hole. The hole 34 in the side surfaces 32, 33 of the tooth cap 5 is still somewhat larger than the hole 20 of the tooth nose 3 at its ends (see FIG. 2), but it is shifted somewhat with respect to the tip 23 of the cap so that the locking bolt rests against the mouth-side wall of the hole and thus holds the tooth cap 5 fast on the tooth nose 3.

I claim:

1. An excavator tooth for attachment to an edge of an excavator bucket, which comprises:

a tooth holder having a wedge-shaped tooth nose with a nose edge and a nose root and sides thereof, said tooth nose extending beyond the edge of the bucket;

a tooth cap which can be placed on the tooth nose and fastened thereon, said tooth cap having a tooth cap body;

curved wedge surfaces on the sides of the tooth nose;

a wedge-shaped hollow space having wedge surfaces thereof and being recessed in the body of the tooth cap, said wedge-shaped hollow space having a base and a mouth, wherein the curved wedge surfaces of the tooth nose extend into the wedge-shaped hollow space, the wedge surfaces of the hollow space being adapted to the wedge surfaces of the tooth nose;

wherein the curved wedge surfaces of the tooth nose and the wedge surfaces of the hollow space have the same circular profiles perpendicular to their longitudinal axes, the radius of curvature of which decreases continuously from the nose edge to the nose root of the tooth nose, and from the base to the mouth of the hollow space;

including a guide web on the wedge surfaces of the tooth nose spaced from the nose root and located in a central region of the wedge surfaces of the tooth nose, including a longitudinal groove in the wedge surfaces of the hollow space of the tooth cap to receive the guide web of the tooth nose, wherein said longitudinal groove terminates inside the mouth of the hollow space; and wherein the tooth holder and tooth cap have lateral faces, and the wedge-shaped hollow space includes an opening at the base thereof, including a bore in the lateral faces for the insertion of a locking pin therein to fasten the tooth cap on the tooth holder, and wherein the bore in the tooth holder for receiving the locking pin has ends and a central part and has a larger diameter at both ends than in the central part, the transition from the larger to the smaller part being developed as a bevel wherein the bore is arranged at a distance from the nose root and at a distance from the opening at the base of the wedge-shaped hollow space.

2. An excavator tooth according to claim 1, wherein the radii of curvature change continuously in a ratio of 1:1.38 to 1:1.64.

3. An excavator tooth according to claim 2, wherein the radii of curvature change continuously in a ratio of 1:1.38 to 1:1.5.

4. An excavator tooth according to claim 1, wherein the bore is in the central plane of the wedge surfaces.

5. An excavator tooth according to claim 1, wherein the bore is parallel to the central plane of the wedge surfaces.

6. An excavator tooth according to claim 1, wherein the distance of the bore from the nose root and the mouth of the hollow space is about one third of the total length of the tooth nose and the hollow space.

7. An excavator tooth according to claim 1, wherein the longitudinal groove flattens off towards the mouth of the hollow space into the wedge surface of the tooth cap and terminates in the wedge surface of the tooth cap.

8. An excavator tooth according to claim 1, wherein the wedge surfaces of the tooth nose and of the hollow space of the tooth cap are provided with a rounding.

9. An excavator tooth according to claim 1, wherein the tooth nose has convexly curved wedge surfaces and the hollow space has concavely curved wedge surfaces.

10. An excavator tooth according to claim 1, wherein the wedge-shaped surfaces on the tooth nose are symmetrically positioned with respect to the central plane of the wedge surfaces.

* * * * *